United States Patent [19]

Kanemitsu et al.

[11] Patent Number: 4,829,335

[45] Date of Patent: May 9, 1989

[54] PROCESS CARTRIDGE AND IMAGE FORMING APPARATUS USING SAME

[75] Inventors: Shinji Kanemitsu, Tokyo; Tokihide Ebata, Tanashi, both of Japan

[73] Assignee: Canon Kabushiki Kaisha, Tokyo, Japan

[21] Appl. No.: 66,658

[22] Filed: Jun. 23, 1987

[30] Foreign Application Priority Data

Jun. 24, 1986 [JP] Japan ..... 61-147421

[51] Int. Cl.[4] ..... G03G 21/00

[52] U.S. Cl. ..... 355/211; 355/210

[58] Field of Search ..... 355/3 R, 3 DR, 133

[56] References Cited

U.S. PATENT DOCUMENTS

| | | | |
|---|---|---|---|
| 3,966,316 | 6/1976 | Pfeifer et al. | 355/3 R |
| 4,425,036 | 1/1984 | Kameyama et al. | 355/3 DR |
| 4,552,030 | 11/1985 | Szecsei | 74/462 |
| 4,575,221 | 3/1986 | Onoda et al. | 355/3 R |
| 4,588,280 | 5/1986 | Ogawa et al. | 355/3 R |
| 4,591,258 | 5/1986 | Nishino et al. | 355/3 R |

FOREIGN PATENT DOCUMENTS

| | | | |
|---|---|---|---|
| 565183 | 1/1924 | France . | |
| 56-6253 | 1/1981 | Japan | 355/3 DR |
| 57-104974 | 6/1982 | Japan | 355/3 DR |
| 59-61847 | 4/1984 | Japan . | |
| 59-152458 | 8/1984 | Japan | 355/3 DR |
| 59-189386 | 10/1984 | Japan . | |
| 61-17169 | 1/1986 | Japan . | |

*Primary Examiner*—Fred L. Braun

*Attorney, Agent, or Firm*—Fitzpatrick, Cella, Harper & Scinto

[57] ABSTRACT

A process cartridge containing as a unit a photosensitive drum and processing elements for repetitive image formation on the photosensitive drum. The process cartridge is mountable into an image forming machine. The process cartridge is provided with a helical gear for driving the photosensitive drum. The helical gear is engaged with another helical gear in the image forming machine, when it is mounted into the image forming machine. The helical gears are twisted in such directions that when the photosensitive drum is driven, the photosensitive drum is urged toward a rear side of the apparatus, whereby during an image forming operation, the process cartridge and/or the photosensitive member is correctly positioned. More particularly, the helical gear of the process cartridge is twisted in a direction which is the same as the direction of rotation of the photosensitive drum during the image forming operation.

21 Claims, 3 Drawing Sheets

PROCESS CARTRIDGE AND IMAGE FORMING APPARATUS USING SAME

FIELD OF THE INVENTION AND RELATED ART

The present invention relates to a process cartridge and an image forming apparatus using the process cartridge, wherein the process cartridge is detachably mountable into the image forming apparatus such as a copying apparatus and printer, more particularly to a driving system for the photosensitive member or drum contained in the process cartridge.

A process cartridge is known which is detachably mountable into a copying apparatus. The process cartridge is correctly positioned in the main assembly of the image forming apparatus by holding a part of a casing of the process cartridge by a positioning member mounted in the main assembly, as disclosed in U.S. Pat. Nos. 4,591,258; 4,566,777; 4,575,221; and 4,588,280; and U.S. Ser. No. 787,260, filed on Oct. 15, 1985, now abandoned. As for the photosensitive drum contained in the process cartridge, a more or less clearance is provided between the casing and the photosensitive drum in order to allow smooth rotation of the photosensitive drum in the process cartridge casing. This, however, may result in a change of the photosensitive drum position with respect to the main assembly when the photosensitive drum is driven from the main assembly side, and therefore, the image quality is deteriorated.

SUMMARY OF THE INVENTION

Therefore, it is desirable in order to produce a good quality image that the photosensitive drum does not shift or displace in the direction of its rotational axis during image forming operation so that it rotates correctly at a predetermined position in spite of the existence of a clearance between a casing of a process cartridge and the photosensitive drum.

Accordingly, it is a principal object of the present invention to provide a process cartridge and an image forming apparatus wherein the photosensitive drum in the process cartridge can be maintained correctly at a predetermined position during its rotation for image formation.

According to an embodiment of the present invention, there is provided a process cartridge including a casing having a photosensitive drum abutting portion which functions as a reference surface, a helical gear for driving the photosensitive drum which is twisted in such a direction that when the photosensitive drum is driven through the helical gear, thrust force is imparted to the helical gear, and therefore, to the photosensitive drum to the abutting portion, whereby the cartridge is urged to a predetermined portion in the main assembly.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

A copying apparatus will be taken as an example of the image forming apparatus according to an embodiment of the present invention.

Figure 1:
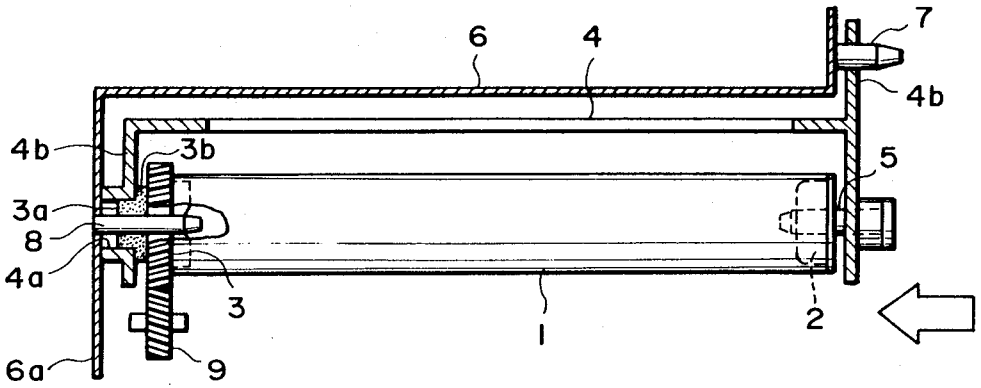
FIG. 1 is a longitudinal section of a part of a process cartridge and a part of an image forming apparatus according to an embodiment of the present invention.

Referring to FIG. 1, a part of the image forming apparatus and a part of a process cartridge according to an embodiment of the present invention are shown as a longitudinal section with respect to an axis of a photosensitive drum. The photosensitive drum is designated by reference numeral 1. To opposite ends of the photosensitive drum 1, a flange 2 and a drum gear 3, which is a helical gear, are fixed. The drum gear 3 is meshed with an unshown driving gear for driving a developing roller 11 to rotationally drive it. The process cartridge has a casing 4 having a drum positioning pin 5, which is inserted into a central bore of the flange 2, and a portion 3*a* of the drum gear 3 is inserted into a bore 4*a* of the cartridge casing, so that the photosensitive drum 1 is rotatably supported in the casing. A main assembly 6 of the copying apparatus has a cartridge positioning pin 7, which is inserted into a hole 4*b* of the process cartridge casing when the process cartridge is inserted into the main assembly in a direction indicated by an arrow in FIG. 1. On the other hand, a pin 8 mounted to the main assembly 6 is inserted into a central bore of the drum gear 3. Thus, the process cartridge 4 is detachably received by the main assembly of the image forming apparatus. The main assembly 6 has a helical gear meshable with the aforementioned helical gear and is effective to drive the photosensitive drum 1 through the helical gear of the process cartridge. The helical gear 9 is driven by an unshown motor and it drives the drum gear 3.

Figure 2:
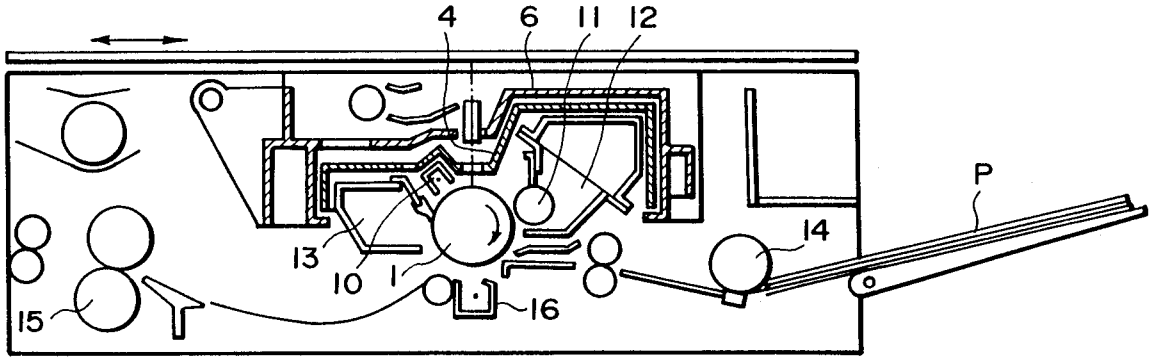
FIG. 2 is a cross-section of an image forming apparatus containing a process cartridge according to the embodiment of the present invention.

As shown in FIG. 2, wherein the process cartridge is shown as being inserted in place in the main assembly, the image forming apparatus further comprises a corona discharger 10, a developing roller 11, a developing device 12 and a cleaning device 13, which constitute in this embodiment process means contributable for forming repetitively on the photosensitive drum. Those process means are contained in the process cartridge 6 as a unit in this embodiment. The main assembly comprises a sheet feeding roller 14 and an image fixing device 15.

In operation, a copy sheet P of paper is fed by sheet feeding roller 14 and is advanced to a photosensitive drum 1 where a transfer corona discharger 16 is opposed thereto and is then processed by the image fixing device 15 and is discharged. The photosensitive drum 1 is rotated in the direction indicated by an arrow, that is, a clockwise direction as shown in FIG. 2.

Figure 3:
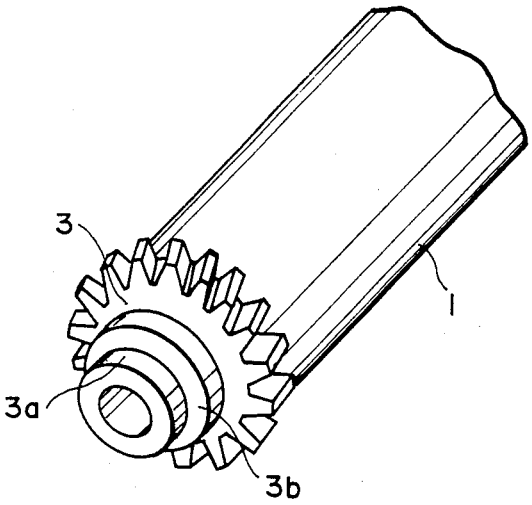
FIG. 3 is a perspective view illustrating a helical gear for driving a photosensitive drum contained in the process cartridge.

As shown in FIG. 3, the drum gear 3 is helically twisted counter clockwisely, that is, the helical drum gear 3 is twisted in the same direction as the direction of the photosensitive drum rotation during image forming operation. When the drum gear 3 is driven by a driving gear 9 which is also helical, the teeth of the drum gear 3 receive force in a direction perpendicular to the gear surface. The force can be resolved into a force in the circumferential direction of the photosensitive drum which is effective to rotate the photosensitive drum, and force in the direction of the rotational axis of the photosensitive drum which provides a thrust force in the leftward direction as seen in FIG. 3, that is, the leftward direction as seen in FIG. 1. Therefore, the photosensitive drum 1 is leftwardly urged.

Figure 4:
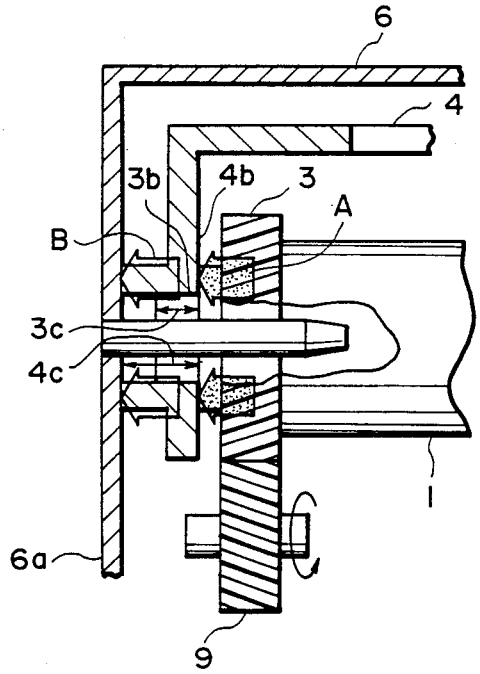
FIG. 4 is a sectional view illustrating the force imparted to the photosensitive drum when the photosensitive drum is being driven.

As shown in FIG. 4, a length 3*c* of the portion 3*b* of the drum gear 3 is shorter than a length 4*c* of the portion 4*a*, and therefore the portion 3*b* of the drum gear 3 pushes the portion 4*b* of the cartridge casing 4 leftwardly (arrow A), and as a result, the portion 4*b* of the casing 4 is leftwardly pushed (arrow B). Thus, the entire cartridge is urged to a portion 6*a* of a frame of the main assembly. Since, in this embodiment, the portion 6*a* of the main assembly is a reference positioning surface, to which a particular portion of the process cartridge casing 4 is abutted. As will be understood from the foregoing, the photosensitive drum 1 and the process cartridge casing 4 is always maintained at a predetermined position precisely by the photosensitive drum 1 being driven.

As will be understood from FIG. 1, the drum gear 3 and the drum driving gear 9 are disposed adjacent the longitudinal end of the process cartridge 4 which is nearer to the reference abutment surface 6*a* of the main assembly when the process cartridge is mounted in the main assembly. This is effective to correctly position the drum gear 3 with respect to the drum driving gear 9 in the thrust direction irrespective of manufacturing variations in lengths of the photosensitive drum. More particularly, the drum gear 3 is in alignment with the drum driving gear in the thrust direction so that the designed meshing conditions therebetween are achieved in actual operation. Therefore, the teeth of the gear are not loaded with extreme force, and additionally, the force is not localized, whereby the meshing efficiency (a rate of a meshing portion to the entire length of the gear) is high, thus providing smooth rotation of the photosensitive drum.

Additional advantageous effects of employing the helical gear will be described, from a technical standpoint.

Because of the use of the helical gear, it is possible to form a high quality image without deterioration of the mechanical strength, even when the diameter of the photosensitive drum is reduced. Since a certain degree of mechanical strength of the gear is required for the drive transmission, there is a limitation to the dimension of the teeth. If the diameter of the photosensitive drum is decreased for the purpose of reducing the size and weight of the apparatus, the number of gear teeth relative to the unit circumferential length of the photosensitive drum decreases. If the photosensitive drum is driven with the relatively small number of gear teeth, the drum rotation becomes non-uniform, more particularly, the drum is substantially intermittently or stepwisely driven due to unavoidable play between gears. As a result, the image becomes now uniform in the circumferential direction of the photosensitive drum, thereby degrading the quality of the image. If the dimensions of the gear teeth are reduced in an attempt to increase the number of teeth, the mechanical strength and therefore the durability of the gear teeth decreases, and simultaneously, smooth meshing engagement at the time of the cartridge insertion is not accomplished. This is particularly important when the helical gears are automatically brought into meshing engagement with each other simply by inserting the process cartridge into the main assembly.

According to this invention, the drum gear 3 of the process cartridge is a helical gear to correct the above described problems simultaneously, as will be understood from the discussions made hereinbefore. Additionally, the helical gear is disposed at such a side of the process cartridge as is a leading side when the process cartridge is mounted into the main assembly, and the photosensitive drum is thrust and urged toward the leading side, when the photosensitive drum is driven through the helical gear, due t the direction of the helical twist of the helical gear. Therefore, the positioning by the helical gear is like an extension of the loading operation of the process cartridge to the correct position in the main assembly.

When the diameter of the photosensitive drum is 25–40 mm, the module of the helical drum gear 3 is preferably 0.5–1.5, and the twist angle is preferably 5–30 degrees, which have been confirmed through various experiments, since then the urging force and the friction between the drum, gear 3 and the cartridge casing 4 are reconciled properly. In the embodiment actually produced, the diameter of the photosensitive drum 1 was 30 mm; and the drum gear 3 had the module of 0.8 and the twist angle of 10 degrees in the counterclockwise direction, with satisfactory results.

Figure 5:
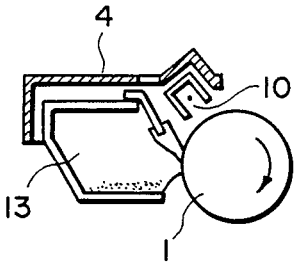
FIGS. 5–9 are sectional views of various modifications of the process cartridge according to embodiments of the present invention.
Figure 6:
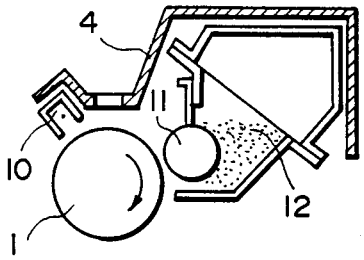
Figure 7:
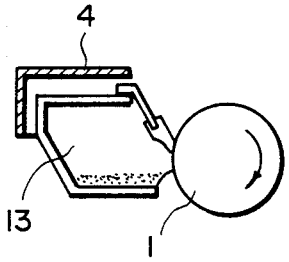
Figure 8:
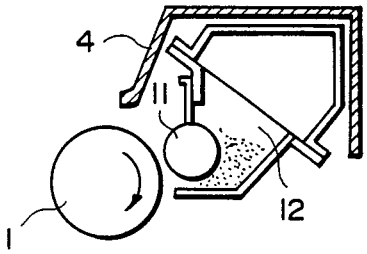
Figure 9:
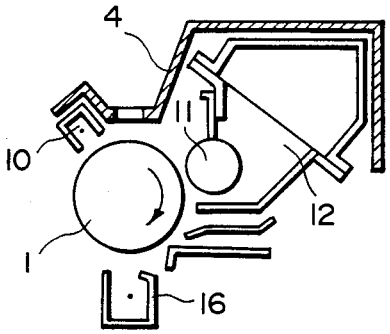

In the foregoing embodiment, the process cartridge detachably mountable into the main assembly contains the photosensitive drum 1, the corona discharger 10, the developing device 12 and the cleaning device 13. As other examples to which the present invention is applicable, the process cartridge may contain the photosensitive drum 1, the corona discharger 10 and the cleaning device 13, as shown in FIG. 5. The process cartridge may contain the photosensitive drum 1, the discharger 10 and the developing device 12 as shown in FIG. 6. The process cartridge main contain the photosensitive drum 1 and the cleaning device 13 or the developing device 12, as shown in FIG. 7 or FIG. 8. As an additional example, the process cartridge may contain the photosensitive drum 1, the discharger 10, the developing device 12 and the transfer discharger 16, as shown in FIG. 9.

As described in the foregoing, according to the present invention, the process cartridge is automatically positioned to a reference position by a force imparted to the photosensitive drum by simply applying the driving force to the photosensitive member, so that the image forming operation can be effected with the process cartridge positioned correctly at the predetermined position during the image forming operation. Also, when the photosensitive drum is driven the process cartridge is moved to the predetermined reference position, and therefore, the process cartridge and the photosensitive drum in the process cartridge are placed in a designed position. Also, even if the diameter of the photosensitive drum is reduced, it is not necessary to reduce the dimensions of the gear teeth, so that a high quality image can be provided even in a small size apparatus without deteriorating the durability thereof.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to an image forming apparatus, comprising:

a rotatably photosensitive member;

helical gear operatively coupled to said photosensitive member and adapted to receive driving force from the image forming apparatus when mounted thereto to drive said photosensitive member and to urge said photosensitive member in the direction of its rotational axis only with the driving force received from the image forming apparatus;

process means contributable to repetitive formation of an image on said photosensitive member; and supporting means for supporting as a unit said photosensitive member and said process means.

2. A process cartridge detachably mountable to an image forming apparatus, comprising:

a rotatable photosensitive member;

a helical gear operatively coupled to said photosensitive member and adapted to receive driving force form the image forming apparatus when mounted thereto to drive said photosensitive member, said helical gear being disposed adjacent one longitudinal end of said photosensitive member and being twisted in such a direction that when it receives the driving force form the image forming apparatus said helical gear urges said photosensitive member toward a side of said process control;

process means contributable to repetitive formation of an image on said photosensitive member; and supporting means for supporting as a unit said photosensitive member and said process means.

3. A catridge according to claim 2, wherein said process cartridge is insertable into the image forming apparatus in a direction of a rotational axis of said photosensitive member, and said side is a leading side when said process cartridge is inserted into the image forming apparatus.

4. A process cartridge detachably mountable to an image forming apparatus, comprising:

a rotatable photosensitive member;

a helical gear operatively coupled to said photosensitive member and adapted to receive driving force from the image forming apparatus when mounted thereto to drive said photosensitive member, said helical gear being disposed adjacent one longitudinal end of said photosensitive member and being twisted in such a direction that when it receives the driving force from the image forming apparatus said helical gear urges said photosensitive member toward a side of said process cartridge;

process means contributable to repetitive formation of an image on said photosensitive member; and supporting means for supporting as a unit said photosensitive member said process means;

wherein said helical gear has a module of 0.8, and has a twist angle, with respect to its rotational axis, of 10 degrees.

5. A process cartridge detachably mountable to an image forming apparatus, comprising:

a rotatable photosensitive member;

a helical gear operatively coupled to said photosensitive member and adapted to receive driving force form the image forming apparatus when mounted thereto to drive said photosensitive member, said helical gear being disposed adjacent one longitudinal end of said photosensitive member and being twisted in such a direction that when it receives the driving force form the image forming apparatus said helical gear urges said photosensitive member toward a side of said process cartridge wherein said helical gear has a module of 0.5–1.5 and has twist angle, with respect to its rotational axis, of 5–30 degrees;

process means contributable to repetitive formation of an image on said photosensitive member; and supporting means for supporting as a unit said photosensitive member and said process means.

6. A cartridge according to claim 5, wherein said process cartride is insertable into the image forming apparatus in a direction of a rotational axis of said photosensitive member, and said side is a leading side when said process cartridge is inserted into the image forming apparatus.

7. A process cartridge detachably mountable to an image forming apparatus, comprising:

a rotatable photosensitive member;

a helical gear operatively coupled to said photosensitive member and adapted to receive driving force form the image forming apparatus when mounted thereto to drive said photosensitive member, said helical gear being disposed adjacent one longitudinal end of said photosensitive member and being twisted in such a direction that when it receives the driving force from the image forming apparatus said helical gear urges said photosensitive member toward a side of said process cartridge;

process means contributable to repetitive formation of an image on said photosensitive member; and supporting means for supporting as a unit said photosensitive member and said process means, said supporting means having a positioning portion for engagement with a positioning portion of the image forming apparatus interrelatedly with mounting of said process cartridge into the image forming apparatus.

8. A cartridge according to claim 7, wherein said positioning portion of said supporting means includes means for defining an opening.

9. A cartridge according to claim 8, wherein the opening is coaxial with the rotational axis of said photosensitive member.

10. A cartridge according to claim 7, wherein the image forming apparatus is an electrophotographic copying apparatus.

11. An image forming apparatus, comprising:

a process cartridge including a rotatable photosensitive member, a helical gear operatively coupled to said photosensitive member, process means contributable to repetitive formation of an image on said photosensitive member, and supporting means for supporting as a unit said photosensitive member and said process means;

means for detachably holding said process cartridge; and a second helical gear meshed with the first mentioned helical gear to drive said photosensitive member;

wherein said photosensitive member is urged in the direction of its rotational axis only by said second helical gear driving said photosensitive member through said first helical gear.

12. An image forming apparatus, comprising:

a process cartridge including a rotatable photosensitive member, a helical gear operatively coupled to said photosensitive member, process means contributable to repetitive formation of an image on said photosensitive member, and supporting means for supporting as a unit said photosensitive member and said process means;

means for detachably holding said process cartridge; and a second helical gear meshed with the first mentioned helical gear to drive said photosensitive member;

wherein said helical gears are twisted in such directions that when said photosensitive member is driven said photosensitive member is urged toward a side of said process cartridge where said first helical gear is provided.

13. An image forming apparatus, comprising:

a process cartridge including a rotatable photosensitive member, a helical gear operatively coupled to said photosensitive member, process means contributable to repetitive formation of an image on said photosensitive member, and supporting means for supporting as a unit said photosensitive member and said process means;

means for detachably holding said process cartridge; and a second helical gear meshed with the first mentioned helical gear to drive said photosensitive member;

wherein said helical gears are twisted in such directions that when said photosensitive member is driven said photosensitive member is urged toward a side of said process cartridge where said first helical gear is provided; and wherein said helical gear has module of 0.5–1.5, and has a twist angle, with respect to its rotational axis, of 5–30 degrees.

14. An apparatus according to claim 13, wherein the module is 0.8, and the twist angle is 10 degrees.

15. An image forming apparatus, comprising:

a process cartridge including a rotatable photosensitive member, a helical gear operatively coupled to said photosensitive member, process means contributable to repetitive formation of an image on said photosensitive member, supporting means for supporting as a unit said photosensitive member and said process means, said supporting means having a positioning portion for positioning said process cartridge;

means for detachably holding said process cartridge;

a second helical gear meshed with said first mentioned helical gear of said process cartridge to drive said photosensitive member; and a second positioning portion for engagement with said first mentioned positioning portion of said process cartridge, said second positioning portion being fixed in a frame of said image forming apparatus;

wherein said helical gears are twisted in such directions that when said photosensitive member is driven said photosensitive member is urged toward a side of said process cartridge where said first helical gear is provided.

16. An apparatus according to claim 15, wherein said first positioning portion includes means for defining an opening in a casing of said process cartridge which functions as said supporting means, and wherein said second positioning portion includes a pin.

17. An apparatus according to claim 15, wherein said first and second positioning portions are engageable interrelatedly with mounting of said process cartridge into said image forming apparatus.

18. An apparatus according to claim 17, wherein said process cartridge is insertable into the image forming apparatus in a direction of a rotational axis of said photosensitive member, and wherein said first helical gear is provided adjacent a side which is a leading side when said process cartridge is inserted into the image forming apparatus.

19. An apparatus according to claim 17, wherein said image forming apparatus is an electrophotographic copying apparatus.

20. An image forming apparatus comprising:

a process cartridge including a rotatable photosensitive member, a helical gear operatively coupled to said photosensitive member, process means contributable to repetitive formation of an image on said photosensitive member, supporting means for supporting as a unit said photosensitive member and said process means, said supporting means having a positioning portion for positioning said process cartridge;

means for detachably holding said process cartridge;

a second helical gear meshed with said first mentioned helical gear of said process cartridge to drive said photosensitive member; and a second positioning portion for engagment with said first mentioned positioning portion of said process cartridge, said second positioning portion being fixed in a frame of said image forming apparatus;

wherein said first and second positioning portions are engageable interrelatedly with mounting of said process cartridge into said image forming apparatus; and wherein said helical gear has a module of 0.5–1.5, and has a twist angle, with respect to its rotational axis, of 5–30 degrees.

21. An apparatus according to claim 20, wherein the module is 0.8, and the twist angle is 10 degrees.

* * * * *

UNITED STATES PATENT AND TRADEMARK OFFICE

CERTIFICATE OF CORRECTION

PATENT NO. : 4,829,335

DATED : May 9, 1989

INVENTOR(S) : SHINJI KANEMITSU, ET AL.

It is certified that error appears in the above-identified patent and that said Letters Patent is hereby corrected as shown below:

COLUMN 2

Line 66, "counter clockwisely," should read --counterclockwise,--.

COLUMN 3

Line 63, "now uniform" should read --non-uniform--.

COLUMN 4

Line 16, "t" should read --to--.
Line 26, "drum, gear" should read --drum gear--.
Line 42, "main" should read --may--.

COLUMN 5

Line 7, "rotatably" should read --rotatable--.
Line 8, "helical gear" should read --a helical gear--.
Line 29, "form" should read --from--.
Line 31, "process control;" should read --process cartridge;--.
Line 36, "catridge" should read --cartridge--.
Line 58, "said" should read --and said--.
Line 67, "form" should read --from--.

COLUMN 6

Line 4, "form" should read --from--.
Line 6, "cartridge" should read --cartridge,--.
Line 7, "twist" should read --a twist--.
Line 15, "cartride" should read --cartridge--.
Line 25, "form" should read --from--.

UNITED STATES PATENT AND TRADEMARK OFFICE

CERTIFICATE OF CORRECTION

PATENT NO. : 4,829,335

DATED : May 9, 1989

INVENTOR(S) : SHINJI KANEMITSU, ET AL.

It is certified that error appears in the above-identified patent and that said Letters Patent is hereby corrected as shown below:

COLUMN 7

Line 34, "module" should read --a module--.

COLUMN 8

Line 27, "apparatus" should read --apparatus,--.

Signed and Sealed this

Third Day of March, 1992

*Attest:*

*Attesting Officer*

HARRY F. MANBECK, JR.

*Commissioner of Patents and Trademarks*